US007604548B2

(12) United States Patent
Cole

(10) Patent No.: US 7,604,548 B2
(45) Date of Patent: Oct. 20, 2009

(54) WEIGHTED CLUB HEADS AND METHODS FOR FORMING THE SAME

(75) Inventor: Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 12/340,269

(22) Filed: Dec. 19, 2008

(65) Prior Publication Data

US 2009/0105009 A1 Apr. 23, 2009

Related U.S. Application Data

(63) Continuation-in-part of application No. 11/070,308, filed on Mar. 1, 2005, now abandoned, and a continuation-in-part of application No. 11/942,531, filed on Nov. 19, 2007, now abandoned.

(51) Int. Cl.
*A63B 53/04* (2006.01)
*A63B 53/06* (2006.01)

(52) U.S. Cl. ..... 473/324; 473/334; 473/341; 473/349; 473/409

(58) Field of Classification Search ..... 473/324–350, 473/288, 251–256, 409
See application file for complete search history.

(56) References Cited

U.S. PATENT DOCUMENTS 4,423,874 A 1/1984 Stuff, Jr.
4,444,395 A 4/1984 Reiss
4,655,459 A 4/1987 Antonious
4,979,744 A 12/1990 Alcala
5,050,879 A 9/1991 Sun et al.
5,060,950 A 10/1991 Finney
5,308,067 A * 5/1994 Cook ..... 473/341
5,439,222 A 8/1995 Kranenberg
5,489,097 A 2/1996 Simmons
5,522,593 A 6/1996 Kobayashi et al.
5,533,730 A 7/1996 Ruvang
5,676,606 A 10/1997 Schaeffer et al.
5,749,790 A 5/1998 Van Alen, II et al.
5,776,010 A 7/1998 Helmstetter et al.
5,833,551 A 11/1998 Vincent et al.
5,938,543 A 8/1999 McGeeney et al.
5,951,412 A 9/1999 Rose et al.
6,206,790 B1 3/2001 Kubica et al.
6,264,571 B1 7/2001 Lekavich
6,270,422 B1 8/2001 Fisher
6,328,662 B1 12/2001 Huang
6,375,583 B1 4/2002 Solheim (Continued)

*Primary Examiner*—Sebastiano Passaniti

(57) ABSTRACT

A method of forming a golf club head includes providing a body having an end portion such as a heel end or a toe end of the club head, wherein the body end portion includes a lower surface and a boss extending therefrom. The method comprises providing a weight having a top surface and a cavity configured to receive the boss, and inserting the boss on the body into the cavity in the weight by rotating the weight about an axis extending normal to the front surface of the body such that the boss interlocks with the cavity and so that at least a portion of the top surface of the weight contacts at least a portion of the lower surface of the body end portion. The weight further includes a protrusion having a concave surface and the body has a corresponding convex surface. Other embodiments are disclosed herein.

25 Claims, 4 Drawing Sheets

U.S. PATENT DOCUMENTS

| | | | | |
|---|---|---|---|---|
| 6,422,950 | B1 | 7/2002 | Whitlam | |
| 6,440,009 | B1 | 8/2002 | Guibaud et al. | |
| 6,450,894 | B1 | 9/2002 | Sun et al. | |
| 6,485,375 | B1 | 11/2002 | McKinley | |
| 6,503,151 | B2 * | 1/2003 | Kosovac | 473/244 |
| 6,699,140 | B1 * | 3/2004 | Sun | 473/252 |
| 6,776,723 | B2 | 8/2004 | Bliss et al. | |
| 6,902,496 | B2 | 6/2005 | Solheim et al. | |
| 7,037,211 | B1 | 5/2006 | Kosovac | |
| 7,326,128 | B2 * | 2/2008 | Cole | 473/335 |
| 2002/0032075 | A1 | 3/2002 | Vatsvog | |
| 2003/0232659 | A1 | 12/2003 | Mahaffey et al. | |
| 2006/0030420 | A1 | 2/2006 | Roake | |
| 2006/0058112 | A1 | 3/2006 | Haralason et al. | |
| 2006/0199662 | A1 | 9/2006 | Cole | |
| 2006/0217214 | A1 | 9/2006 | Cole | |

* cited by examiner

WEIGHTED CLUB HEADS AND METHODS FOR FORMING THE SAME

CROSS REFERENCE TO RELATED APPLICATIONS

This application is a continuation-in-part application of U.S. patent application Ser. No. 11/070,308, filed Mar. 1, 2005 now abandoned, and a continuation-in-part application of U.S. patent application Ser. No. 11/942,531, filed Nov. 19, 2007 now abandoned. The disclosure of the related applications listed above is incorporated herein by reference.

TECHNICAL FIELD

This disclosure relates generally to sports equipment, and relates more particularly to weighted club heads and methods for forming the same.

BACKGROUND

To increase the moment of inertia of the club, heel and/or toe weights may be incorporated into a club head. This increased moment of inertia may reduce club head twisting if a golf ball impacts the strike face of the club head at an off-center location. To increase the moment of inertia, some club heads utilize a low density material for the club head body in conjunction with a higher density material for the heel and toe weights.

In contrast to existing golf clubs, the methods, apparatus, and articles of manufacture described herein may allow one or more weights to be easily and securely attached to the club head body. Further, the methods, apparatus, and articles of manufacture described herein may allow variable or custom weights to be interchanged after the club head has been manufactured.

Figure 1:
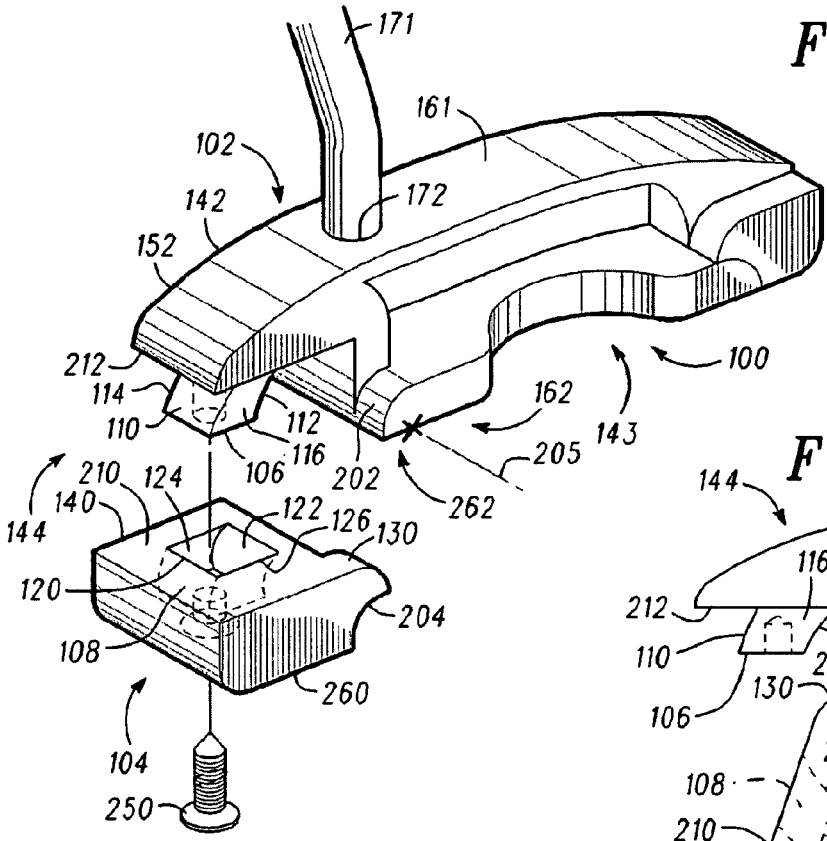
FIG. 1 illustrates a partially exploded, perspective view of a club head.

For simplicity and clarity of illustration, the drawing figures illustrate the general manner of construction, and descriptions and details of well known features and techniques may be omitted to avoid unnecessarily obscuring of the drawings. Additionally, elements in the drawing figures are not necessarily drawn to scale. For example, the dimensions of some of the elements in the figures may be exaggerated relative to other elements to help improve understanding of different embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the present disclosure are, for example, capable of operation in sequences other than those illustrated or otherwise described herein. Furthermore, the terms "include," and "have," and any variations thereof, are intended to cover a non-exclusive inclusion, such that a process, method, system, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the weighted club heads and methods for forming the same described herein are, for example, capable of operation in orientations other than those illustrated or otherwise described herein.

The terms "couple," "coupled," "couples," "coupling," and the like should be broadly understood and refer to connecting two or more elements, mechanically and/or otherwise. Coupling may be for any length of time, e.g., permanent or semi-permanent or only for an instant. The absence of the word "removably," "removable," and the like near the word "coupled," and the like does not mean that the coupling, etc. in question is or is not removable.

DESCRIPTION

The present disclosure relates to a club head having a body fitted with heel and/or toe weights attached in advantageous manners. In accordance with one embodiment, a method of forming a club head includes providing a body having an end portion (e.g., a heel or a toe end of the club head) wherein the body end portion includes a lower surface and a boss extending therefrom. The method also includes providing a weight having a top surface and a cavity configured to receive the boss and inserting the boss into the cavity in the weight. The insertion can include rotating the weight such that the boss interlocks with the cavity and such that at least a portion of the top surface of the weight contacts at least a portion of the lower surface of the end portion of the body. In accordance with the same or different embodiment, the weight further includes a protrusion having a concave surface and the body has a corresponding convex surface. In this embodiment, the insertion of the boss into the cavity can further include rotating the weight about an axis extending through the body such that the concave surface of the weight bears on the convex surface of the body.

In the same or a different embodiment, a method of forming a club head can include providing a body comprising a front surface, a rear surface, an arcuate body surface between the front and rear surfaces, and a first end portion between the front and rear surfaces, where the first end portion comprises a lower surface and a boss extending therefrom. The method can further include providing a weight extending from the front surface of the body to the rear surface of the body, where the weight comprising a top surface, a cavity to receive the boss, and a protrusion comprising an arcuate weight surface.

The weight can be interlocked with the first end portion by, for example, rotating the weight about an axis normal to the front surface of the body, interlocking the arcuate weight surface and the arcuate body surface against each other, and interlocking the boss and the cavity against each other.

Proceeding with the figures, FIG. 1 illustrates a partially exploded, perspective view of club head 100 comprising body 102 and weight 104 in accordance with one embodiment. Body 102 comprises body end portion 144 at a heel end of club head 100. In a different embodiment, body end portion 144 could be located at a toe end of club head 100 instead. FIG. 1 also shows club head 100 coupled to shaft 171 at hosel 172. Although shown as a cavity into top side 161 of club head 100, hosel 172 also can protrude from body 102 in other embodiments. Club head 100 is shown as a putter in the present embodiment, but in other embodiments could comprise other types of heads such as a driver head, a hybrid head, and a fairway wood head, among others. The teachings in this disclosure are not limited to any specific type of club or club head.

Figure 2:
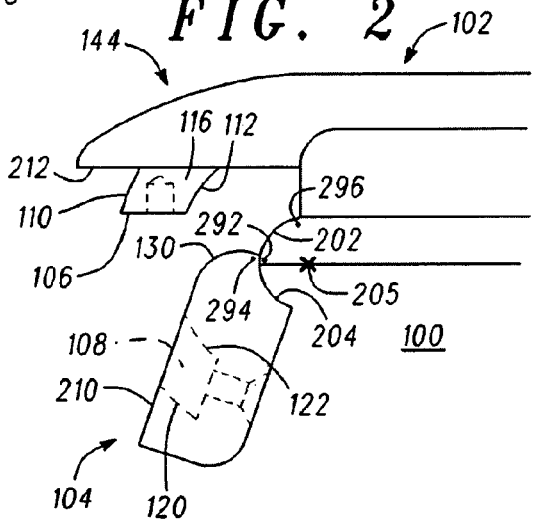
FIGS. 2-4 illustrate a side view of a portion of the club head of FIG. 1 during different stages of assembly.
Figure 3:
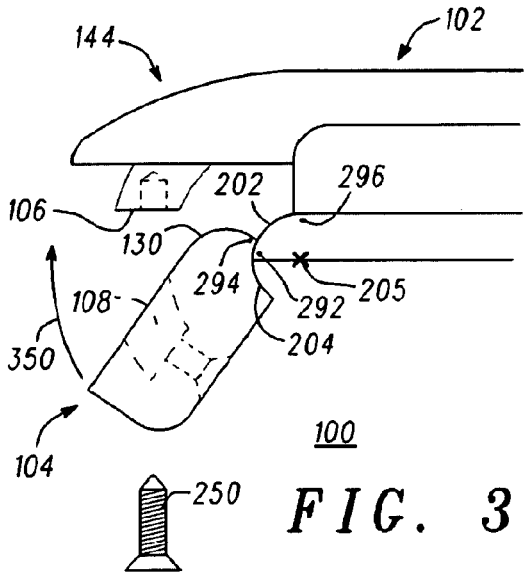
Figure 4:
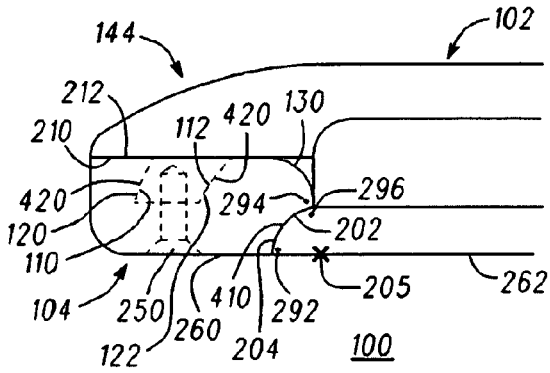

FIGS. 2-4 show the insertion of boss 106 within cavity 108 during assembly or formation of an exemplary putter head. For example, FIG. 2 illustrates a side view of weight 104 and part of body 102 at an initial stage of interlocking. FIG. 3 illustrates a side view of weight 104 and part of body 102, where body 102 is being rotated in the direction of arrow 350 to be interlocked, and FIG. 4 illustrates a side view of weight 104 and part of body 102 fully interlocked.

As shown in FIG. 3, weight 104 can be positioned such that boss 106 is aligned to enter cavity 108, while concave weight surface 204 is placed in contact with convex body surface 202 of body 102. As shown in FIG. 1, convex body surface 202 is located at the rear of body 102 and is not located in the middle or the front of body 102. Similarly, concave weight surface 204 is located at the rear of club head 100 when weight 104 is interlocked with body 102. In other embodiments, convex body surface 202 and concave weight surface 204 can be located at other portions of club head 100.

Convex body surface 202 can provide a point of leverage to assist rotating weight 104 into engagement with boss 106. Weight 104 is then further rotated about axis 205, which also generally corresponds to the center of curvature of arcuate surfaces of weight 104 and body 102 (e.g., surfaces 110, 112, 120, and 122 shown in FIGS. 1 and 2). Weight 104 is rotated until interlocked with body 102, e.g., until juncture area 210 of weight 104 at least partially contacts juncture area 212 of body 102, as shown in FIG. 4.

More specific details on the interlocking between different elements of weight 104 and body 102 are described in more detail below. In the present example, club head 100 comprises strike face 152, and strike face 152 comprises front surface 142 of body 102 and front surface 140 of weight 104. Surfaces 142 and 140 are substantially planar with each other when boss 106 and cavity 108 are wedged together, as shown in FIG. 4. Also in the present example, club head 100 comprises sole 162, and sole 162 comprises bottom surface 260 of weight 104 and bottom surface 262 of body 102. In the present embodiment, surfaces 260 and 262 are substantially planar with each other when boss 106 and cavity 108 are wedged together, as shown in FIG. 4. In a different embodiment, sole 162 could comprise a curvature, such as a convex curvature along a length of sole 162. In the same embodiment, surfaces 260 and 262 could be correspondingly curved to the curvature of sole 162.

Starting with body 102 of club head 100, front surface 142 and rear surface 143 can be located at opposite sides of body 102, as shown in FIG. 1. In some examples, front surface 142 could be part of the strike face of the club head 100, while tear surface 143 could be part of the backside of club head 100. Body 102 also comprises body end portion 144 located between front and rear surfaces 142-143, and located towards a heel portion of body 102. In a different embodiment, body end portion 144 could be located elsewhere with respect to body 102, such as proximate to a toe portion of body 102. Convex body surface 202 of body 102 is also located between front and rear surfaces 142-143, proximate to body end portion 144. Body end portion 144 comprises juncture area 212 facing substantially opposite to top side 161 of body 102 in the present example. In addition, boss 106 extends from juncture area 212, and comprises two generally arcuate surfaces 110 and 112 at opposite sides of boss 106, and two generally planar surfaces 116 and 114 at opposite sides of boss 106. Arcuate surfaces 110 and 112 configure boss 106 as an arc that extends from juncture area 212 and away from body 102 in a concave arc with respect to sole 162 of body 102.

Club head 100 also comprises weight 104 configured to interlock with body end portion 144, where weight 104 comprises a density greater than a density of body 102. In some examples, weight 104 could be referred to as a ballast. In one embodiment, weight 104 can be heavier than body 102. In another embodiment, weight 104 can be approximately 5 to 50 percent of the total mass of club head 100, which does not include shaft 171.

As illustrated in the sequence of FIGS. 2-4, weight 104 and body end portion 144 are configured to interlock with each other upon a rotation of weight 104 about axis 205, where axis 205 is substantially normal to front surface 142 of body 102. Axis 205 is also located at sole 162 of club head 100 in the present example. In other examples, where curve 162 comprises a curvature, axis 205 could also be located at sole 162. Such location of axis 205 can permit extremity 292 of convex body surface 202 (FIG. 4) to be less acute and/or substantially perpendicular relative to sole 162. This can be beneficial, for example, to restrict extremity 292 from cutting into turf during a putting stroke, and/or to prevent extremity 292 from picking up dirt.

Weight 104 can extend from front surface 142 to rear surface 143 when interlocked with body end portion 144, and comprises juncture area 210, cavity 108, and protrusion 130. In the present example, juncture area 210 comprises a top surface of weight 104, and protrusion 130 comprises concave weight surface 204 complementary to convex body surface 202 of body 102. Both concave weight surface 204 and convex body surface 202 are configured to slide across each other upon the rotation of weight 104 about axis 205. When weight 104 is interlocked with body end portion 144 after the rotation of weight 104 about axis 205 as shown in FIG. 4, juncture area 212 of body end portion 144 lies adjacent to and on top of juncture area 210 of weight 104 such that convex body surface 202 is located below and wedged against concave weight surface 204. In some examples, press-fit 410 (FIG. 4) may be formed between concave weight surface 204 and convex body surface 202 when concave weight surface 204 and convex body surface 202 wedge together. As a result, concave weight surface 204 and convex body surface 202 can press against each other when weight 104 is interlocked with body end portion 144, thereby restricting potential vibrations of weight 104 relative to body 102.

Cavity 108 of weight 104 is configured to receive boss 106 of body 102 when weight 104 and body end portion 144 are interlocked with each other. In the present example, cavity 108 comprises arcuate surface 122 complimentary to arcuate surface 112 of boss 106, and two generally planar surfaces 126 and 124 complimentary to planar surfaces 116 and 114, respectively, of boss 106. Arcuate surfaces 112 and 122 are configured to slide across each other upon the rotation of weight 104 about axis 205. Cavity 108 also comprises arcuate surface 120 complimentary to arcuate surface 110 of boss 106, but in a different example, surfaces 120 and 110 need not be arcuate and/or complementary to each other. Nevertheless, in the present example, arcuate surfaces 120 and 110 are configured to slide across each other upon the rotation of weight 104 about axis 205.

Club head 100 can be configured such that, when weight 104 is interlocked with body end portion 144, juncture area 212 of body end portion 144 lies adjacent to juncture area 210 of weight 104 such that arcuate surface 122 of cavity 108 is wedged against arcuate surface 112 of boss 106, thereby wedging boss 106 against cavity 108. In the present example, arcuate surface 120 of weight 104 is similarly wedged against arcuate surface 110 of boss 106. In some examples, press-fit 420 (FIG. 4) may be formed between surfaces 112 and 122, and/or between surfaces 110 and 120, when boss 106 and cavity 108 wedge together. Boss 106 and cavity 108 may thus press against each other when weight 104 is interlocked with body end portion 144, thereby further restricting potential vibrations of weight 104 relative to body 102.

Club head 100 can also comprise, as in the present example, fastener 250 configured to be inserted through weight 104 and into boss 106 to secure weight 104 to body end portion 144 of body 102. In examples comprising press-fits 410 and/or 420, fastener 250 can place club head 100 in a stressed condition when securing weight 104 to body 102. The stressed condition can be beneficial in some embodiments for reducing or restricting vibrations between weight 104 and body 102. In the present example, fastener 250 comprises a machine screw, but fastener 250 may comprise different types of screws or other elements for fastener 250, such as nails, rivets, pins, soldering material, brazing material, magnets, and/or adhesives like glue or epoxy. Alternatively, fastener 250 can be eliminated when, for example, at least one of boss 106 or weight 104 comprises a magnet and the other one of boss 105 and weight 104 comprises a magnet (of opposite polarity) or a metal.

As disclosed herein, body 102 and/or weight 104 can comprise any suitable metal, plastic, composite material, or combination thereof. In accordance with one embodiment, body 102 comprises a material such as titanium or a high-purity titanium alloy, e.g., commercial pure grade 2 titanium, and weight 104 comprises a material whose density is greater than that of body 102, e.g., tungsten. While body 102 and weight 104 may be fabricated from a metallic material, the present disclosure is not so limited. For example, the primary constituent of body 102 can include a composite or plastic material having the desired characteristics.

Depending upon the selected material or materials, body 102 may be fabricated using any suitable process now known or later developed, including a variety of conventional casting methods such as investment-casting, forging, powdered-metal processing, and/or metal machining. In one embodiment, body 102 can be formed via a suitable casting process, and afterwards, the assembled unit (with heel and/or toe weights) can be milled to finish the various exposed surfaces.

The shape and materials used for body 102 and weight 104 can be defined by any suitable factors, including, for example, club head type, desired moment of inertia (e.g., the polar moment of inertia around an axis normal to the club head sole), desired center of gravity, desired aesthetic properties (e.g., visual cues provided by the club head's contours as viewed from above during play), and/or the desired weight, mass, and density. In this regard, the exemplary club head shapes depicted in herein are for illustrative purposes only and are not limitations of the club head.

Figure 5:
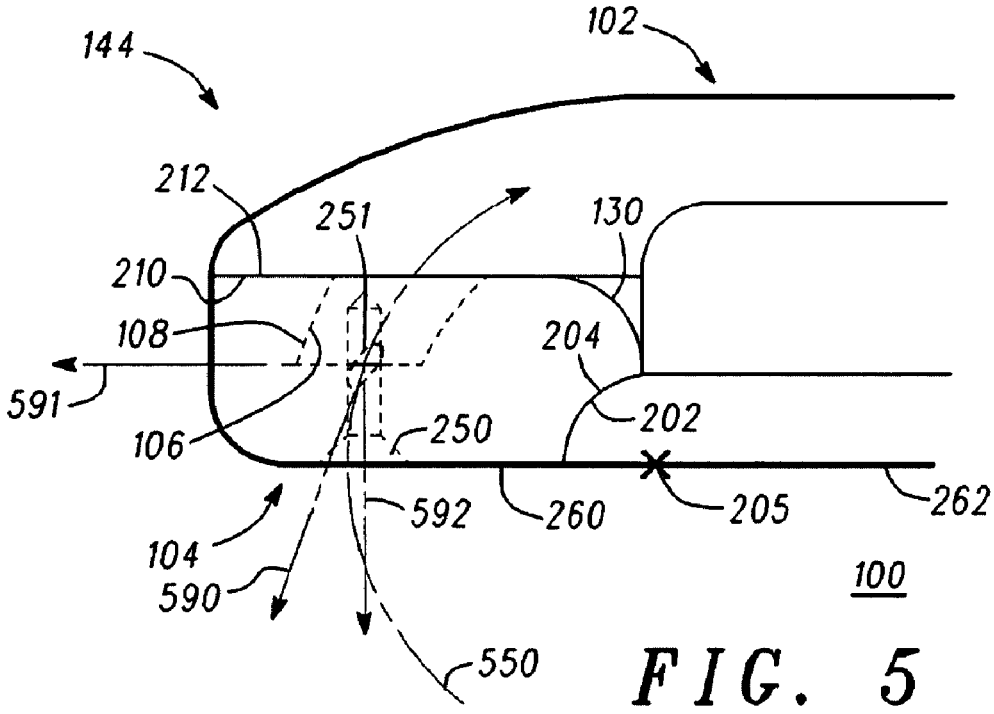
FIG. 5 illustrates the side view of FIG. 4 and highlights an oblique distribution of stresses across a fastener of the club head of FIG. 1.

Continuing with the figures, FIG. 5 illustrates the side view of FIG. 4 and highlights an oblique distribution of stresses across a fastener. Fastener 250 is configured in the present embodiment to distribute shear and tensile stresses across an oblique cross-section 251 of fastener 250. The shear and tensile stresses are generated as a result of interactions between convex body surface 202 and concave weight surface 204, and/or between boss 106 and cavity 108, when weight 104 and body end portion 144 of body 102 are interlocked. For example, because of the arcuate shape of arcuate elements (such as boss 106, cavity 108, convex body surface 202, and concave weight surface 204), weight 104 can normally only dislodge from body end portion 144 in an arcuate path opposite to path 550 initially followed to interlock weight 104 and body end portion 144 together. In some cases, interactions between the arcuate elements could act upon fastener 250 as resultant stresses 590, which are angled obliquely with respect to a length of fastener 250 and which are spread across oblique cross-section 251 of fastener 250. Resultant stresses 590 could be a composite of shear stresses 591 and tensile stresses 592 acting upon fastener 250. In some examples, resultant stresses 590 could be a product of press-fits 410 and/or 420 (FIG. 4) between the arcuate elements of club head 100.

Figure 6:
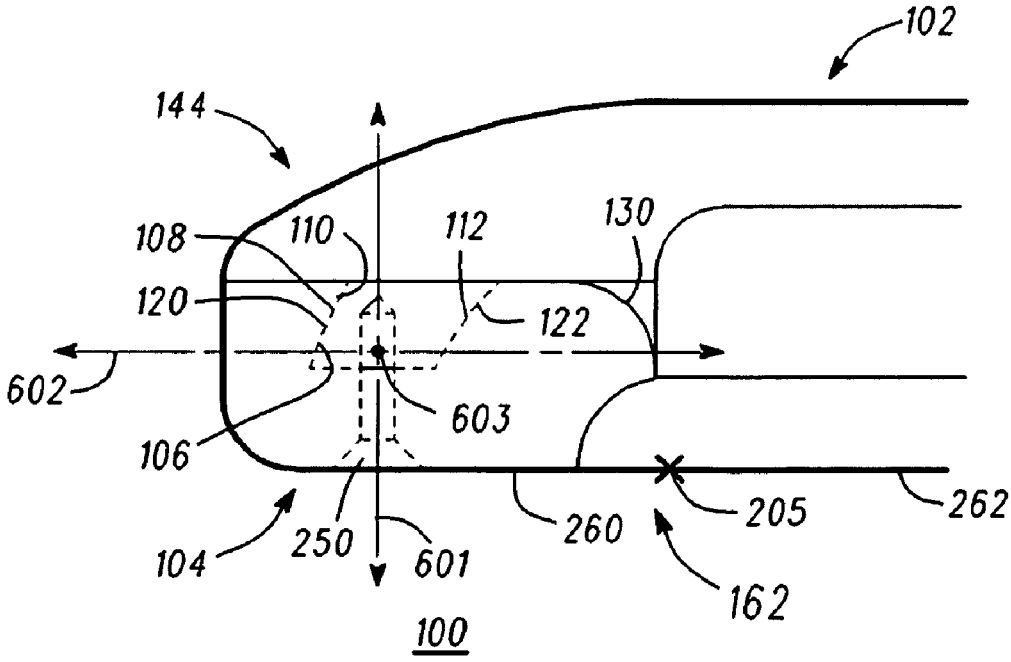
FIG. 6 illustrates the side view of FIG. 4 and shows the weight of the club head secured to the body of the club bead along three axes.

FIG. 6 illustrates the side view of FIG. 4 and shows weight 104 secured to body 102 along three axes. In the present embodiment, boss 106 and cavity 108 are configured to restrict a displacement of weight 104 along three axes, such as axes 601-603 in FIG. 6. The three axes are substantially perpendicular to each other relative to body 102. In some examples, the restriction of the displacement of weight 104 may be further enhanced by the interacting forces from press-fit 420.

For example, in the present embodiment, surface 110 of boss 106 and surface 120 of weight 104 are wedged together to restrict a displacement of weight 104 along axis 602 towards body 102, and along axis 601 towards sole 162 of club head 100. Convex body surface 202 and concave weight surface 204 serve a similar function as surfaces 110 and 120. Also, surface 112 of boss 106 and surface 122 of weight 104 are wedged together to restrict a displacement of weight 104 along axis 602 away from body 102, and along axis 601 towards top side 161 of club head 100. In addition, surfaces 114 and 116 of boss 106 (FIG. 1) are wedged against surfaces 124 and 126, respectively, of weight 104 (FIG. 1) to restrict displacement of weight 104 along axis 603.

In some embodiments, club head 100 can also comprise an alternate weight (not shown) similar to weight 104, but having a different mass than that of weight 104. The alternate weight can be configured to interlock with body end portion 144 upon a rotation of the alternate weight about axis 205, similar to the way weight 104 interlocks with body end portion 144. The provision of the alternate weight can permit the custom weighting of club head 100 for different situations and/or preferences.

Figure 7:
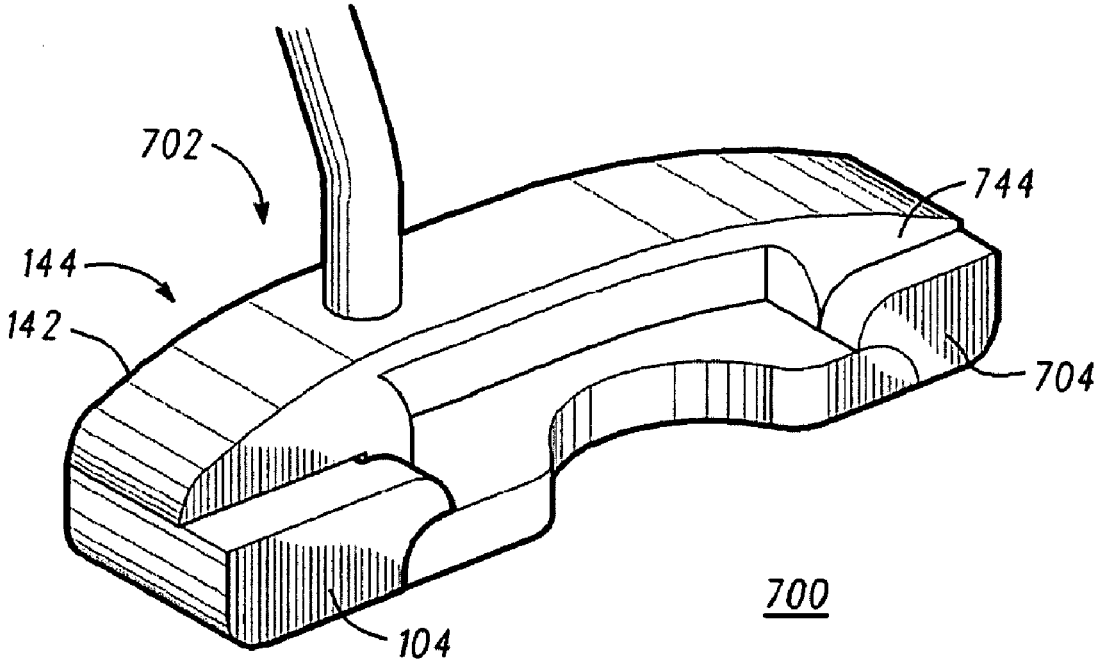
FIG. 7 illustrates a perspective view of a second club head having the weight of FIG. 1 and another weight.

FIG. 7 illustrates a perspective view of a club head 700 having two weights. Club head 700 is similar to club head 100 (FIGS. 1-6), but comprises body 702 instead of body 102, and includes body end portion 744 substantially opposite body end portion 144. Club head 700 further comprises weight 704, similar to weight 104, but configured to interlock instead with body end portion 744. Weight 704 can interlock with body end portion 744 similar to the way that weight 104 interlocks with body end portion 144, as described above. In the present example, weights 104 and 704 are absent from a portion of body 702 between body end portions 144 and 744, such that weights 104 and 704 are not contiguous with each other and are also not adjacent to each other. The placement of weights 104 and 704 toward the antipodal extremes of the toe and heel ends of club head 700 can increase the moment of inertia of club head 700. Weights 104 and 704 are also kept low and close to sole 162, which can lower the center of mass of club head 700 and provide other benefits.

Figure 9:
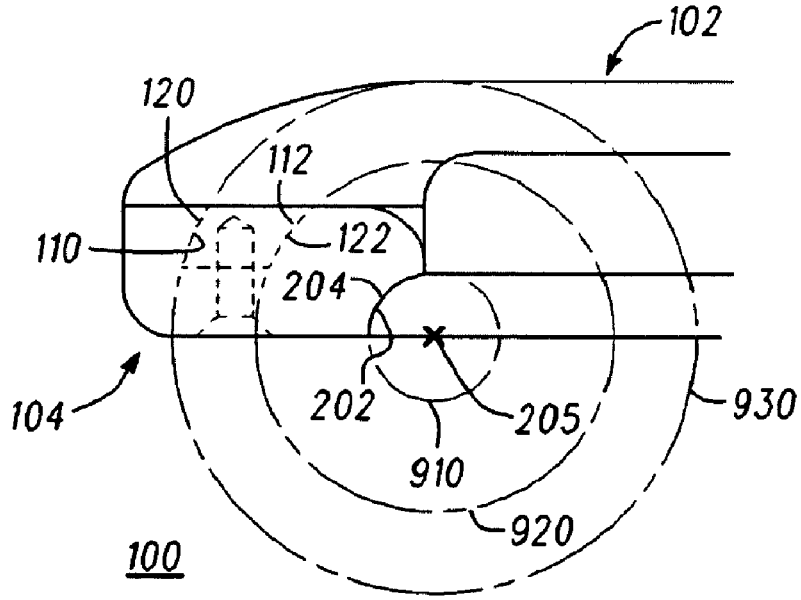
FIG. 9 illustrates the side view of FIG. 4 and highlights the interlocking of the weight and body of the club head relative to concentric circles about an axis substantially normal to a front surface of the body.

Skipping ahead in the figures, FIG. 9 illustrates the side view of FIG. 4 and highlights the interlocking of weight 104 and body 102 relative to concentric circles about axis 205. In some examples, each of arcuate surfaces 110 and 112 of boss 106, arcuate surfaces 120 and 122 of cavity 108, concave weight surface 204, and convex body surface 202 can be configured to form portions of concentric circles relative to axis 205. For example, as shown in FIG. 9, concave weight surface 204 and convex body surface 202 can form a portion of circle 910; arcuate surfaces 112 and 122 can form a portion of circle 920; and arcuate surfaces 110 and 120 can form a portion of circle 930. Each of circles 910, 920, and 930 are concentric about axis 205. Such an arrangement can facilitate and/or guide the rotation of weight 104 towards body end portion 144 as boss 106 is wedged against cavity 108.

Figure 8:
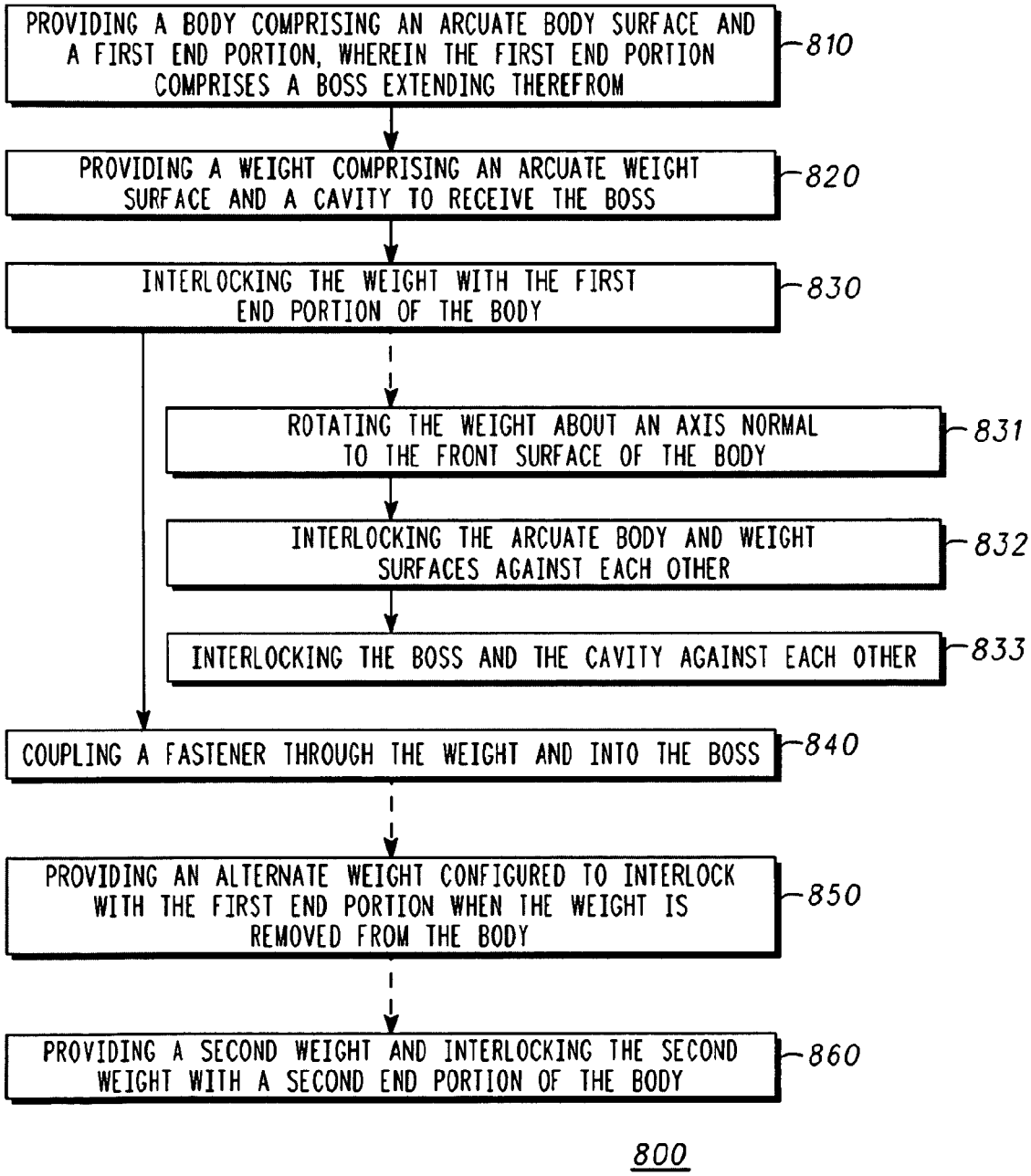
FIG. 8 illustrates a flowchart for a method of forming a club head.

Turning to the remaining figure, FIG. 8 illustrates a flowchart for method 800 of assembling or forming a club head. In some examples method 800 can comprise a portion of a manufacturing process. In the same or different examples, the club head of method 800 can be similar to club head 100 (FIGS. 1-6 and 9), or club head 700 (FIG. 7).

Block 810 of method 800 involves providing a body comprising an arcuate body surface and a first end portion, wherein the first end portion comprises a boss extending therefrom. In the present example, the boss of method 800 extends from a lower surface of the first end portion, similar to juncture area 212 of body end portion 144 (FIGS. 1-4). In some examples, the body of block 810 can be similar to body 102 (FIGS. 1-6) and/or to body 702 (FIG. 7). The first end portion of the body can be similar to one of body end portions 144 (FIGS. 1-6 and 9) or 744 (FIG. 7), and the boss can be similar to boss 106 (FIGS. 1-7 and 9). In some examples, the arcuate body surface of the body of block 810 can be located between front and rear surfaces of the body, where the arcuate body surface can be similar to convex body surface 202 of body 102 (FIGS. 1-3).

Block 820 of method 800 involves providing a weight comprising an arcuate weight surface and a cavity to receive the boss. The weight can be similar to weight 104 (FIGS. 1-7), and can extend from the front surface to the rear surface of the body of block 810. In some examples, the cavity can be similar to cavity 108 (FIGS. 1-3), and can be configured to interlock with the boss of block 810. The weight can also comprise a protrusion having the arcuate weight surface, which can be similar to weight concave surface 204 of protrusion 130 (FIGS. 1-7 and 9), and can be configured to interlock with the arcuate body surface of block 810.

Block 830 of method 800 involves interlocking the weight of block 820 with the first end portion of the body of block 810. In some examples, the weight can be interlocked with the first end portion of the body as described above for interlocking weight 104 to body end portion 102 through the sequence of FIGS. 2-4. In the same or a different example, block 830 can comprise aligning a front surface of the weight to be substantially planar with a front surface of the body, and/or rotating the weight into the first end portion of the body to form a portion of a strike face of the club head of method 800. The strike face can thus comprise the front surfaces of the weight and the body substantially planar with each other, as described above for strike face 152 and front surfaces 140 and 142 in FIG. 1. The insert of the boss into the cavity can automatically align the front surfaces of the weight and the body to be substantially planar with each other.

In some embodiments, block 830 comprises sub-block 831, comprising rotating the weight about an axis normal to the front surface of the body of block 810, where the axis can be similar to axis 205 in FIGS. 1-4. In the same or different examples, the weight can be rotated about the axis until the bottom surface of the weight is substantially planar with the bottom surface of the body, as described above for bottom surfaces 260 and 262 of weight 204 and body 102, respectively, in FIG. 1. In examples where the axis is located adjacent to the sole of the club head, the junction between the weight and the body near the sole, proximate to extremity 292 of convex body surface 202 in the example of FIG. 4, can be less acute and/or substantially perpendicular relative to the sole. Being less acute, the junction will be less likely to cut into turf and/or to pick up dirt during a stroke of the club head of method 800.

Sub-block 831 can also comprise positioning an extremity of the arcuate weight surface against an extremity of the arcuate body surface, and then moving the weight against the first end portion of the body in an arcuate path. In the present example, the arcuate path can be as indicated by directional arrow 350 in FIG. 3. The arcuate path can be traversed as the arcuate weight and body surfaces slide past each other, e.g., when the extremity of the arcuate weight surface moves from a first extremity of the arcuate body surface towards a second extremity of the arcuate body surface. In the present example, the first and second extremities of the arcuate body surfaces can be extremities 292 and 296, respectively, and the extremity of the arcuate weight surface can be extremity 294, as illustrated in FIGS. 2-4. In some examples, a press-fit may be formed between concave weight surface 204 and convex body surface 202 as extremity 294 of weight 104 approaches extremity 296 of body 102.

In the same or a different embodiment, block 830 can also comprise sub-block 832, which comprises interlocking the arcuate body and weight surfaces against each other. Sub-block 832 can involve pressing the arcuate weight and body surfaces against each other as the weight of block 820 is pressed against the first end portion of the body of block 810. The weight can be pressed against the first end portion along the arcuate path described for sub block 831 until the top surface of the weight and the lower surface of the first end portion of the body couple together. In some embodiments, sub-block 832 will create a press-fit between the arcuate weight and body surfaces, similar to press-fit 410 shown in FIG. 4. In such cases, the arcuate weight and body surfaces could exert forces against each other to secure the weight in place and/or to prevent or restrict vibrations of the weight relative to the body.

Block 830 can also comprise sub-block 833 in some embodiments, involving interlocking the boss of the body of block 810 and the cavity of the weight of block 820 against each other. In some examples sub-block 833 can comprise pressing the boss against the cavity as the weight is pressed against the first portion of the body. The box can be pressed against the cavity along the arcuate path described for sub block 831, until the top surface of the weight and the lower surface of the first end portion of the body couple together. In some embodiments, sub-block 833 will also result in the formation of a press-fit, this time between the boss of the body and the cavity of the weight, similar to press-fit 420 shown in FIG. 4. In such cases, surfaces of the boss and the cavity could exert forces against each other to secure the weight in place and/or to prevent or restrict vibrations of the weight relative to the body.

In the same or a different embodiment, the interlocking of the boss and the cavity in sub-block 833 can comprise the interlocking of a first surface of the boss against a first surface of the cavity, the interlocking of a second surface of the boss against a second surface of the cavity, and the coupling of a third surface of the boss adjacent to a third surface of the cavity. Such an arrangement can be implemented to restrict a displacement of the weight along three axes substantially perpendicular to each other, such as described in FIG. 6 with respect to axes 601-603 and to surfaces 110, 120, 112, 122, 114, 116, 124, and/or 126.

For block 830, some examples may comprise interlocking an arcuate boss surface of the boss (block 810) with an arcuate cavity surface of the cavity (block 820) to form a portion of a first circle, while the arcuate weight surface (block 820) and the arcuate body surface (block 810) form a portion of a second circle. In these examples, the first and second circles are concentric relative to the axis (sub-block 831) when the weight and the first end portion of the body are interlocked. As an example, the first and second circles can be similar to circles 910 and 920, and the arcuate boss, cavity, weight, and body surfaces can be similar to surfaces 112, 122, 204, and 202, respectively, as shown in FIG. 9. In the same or a different example, the arcuate boss and weight surfaces can be concave, while the arcuate cavity and body surfaces can be convex.

Still in block 830, in the same or a different embodiment, a second arcuate boss surface of the boss (block 810) can be interlocked with a second arcuate cavity surface of the cavity (block 820) to form a portion of a third circle. The third circle can be concentric with the first and second circles about the axis (sub-block 831). As an example, the third circle can be similar to circle 930, and the second arcuate boss and cavity surfaces can be similar to surfaces 110 and 120, respectively, as shown in FIG. 9. In the same or a different example, the second arcuate boss surface can be convex, while the second arcuate cavity surface can be concave.

In some embodiments, the subparts of block 830 can be carried out simultaneously, such that the arcuate weight and body surfaces, and the boss and the cavity, could interlock as the weight is rotated about the axis to interlock with the body. In other embodiments, the sequence of sub-blocks 832 and 833 can be reversed.

Method 800 can also comprise block 840, which includes coupling a fastener through the weight and into the boss. In some examples, the fastener can be as described above for fastener 250 securing weight 104 to body end portion 144. The fastener could comprise a screw, as illustrated in FIGS. 1-4, and/or at least one of a nail, a rivet, a pin, a soldering material, a brazing material, a magnet, and/or an adhesive like glue or epoxy. In the same or a different example, the fastener could be inserted along an insertion axis, such as axis 601 (FIG. 6), through the weight and into the boss, where the insertion axis is different from the axis normal to the front surface of the body.

In some examples, when interlocked, one or more of the arcuate body surface (block 810), the arcuate weight surface (block 820), the boss (block 810), and/or a surface of the cavity (block 820) can exert shear and tensile stresses against the fastener along at least two substantially perpendicular axes, such that at least a portion of the shear and tensile stresses are distributed across an oblique cross-section of the fastener. Such a situation can be similar to the one illustrated in FIG. 5, where resultant stresses 590, as composites of shear and tensile stresses 591-592, are exerted and distributed obliquely across cross-section 251 of fastener 250.

In some embodiments, the interlocking between the weight and the first end portion, and/or the oblique distribution of stresses upon the fastener, can provide greater strength for the club head of method 800. For example, in the embodiment of FIG. 5, weight 104 is restricted to circular path 550 about axis 205 as a result of the interlocking of boss 106 with cavity 108, and of body convex surface 202 with weight concave surface 204. Therefore, resultant stresses 590 upon fastener 250 can tend to be limited to a direction substantially tangential to circular path 550, and therefore obliquely across fastener 250. Stresses exerted in other directions upon club head 100, including impact forces, can be absorbed directly by interface elements such as boss 106, cavity 108, body convex surface 202, weight concave surface 204, juncture area 212, and/or juncture area 210. This distribution of the impact forces across the interface elements limits the involvement of fastener 250 in absorbing and/or dissipating such stresses, which can be beneficial in situations where fastener 250 is comparatively weaker than the interface elements. In addition, the oblique distribution of resultant stresses 590 across fastener 250 provides a larger area (e.g., oblique cross-section 251) for stress absorption or dissipation across fastener 250.

Continuing with method 800, a block 850 can comprise providing an alternate weight configured to interlock with the first end portion when the weight is removed from the body. Block 850 can be optional, and in some embodiments the alternate weight of block 850 can be similar to the alternate weight previously described for club head 100. When used, the alternate weight can be configured to interlock with the first end portion of the body of block 801 after the weight of block 802 is removed.

Method 800 can also comprise optional block 860 for providing a second weight and interlocking the second weight with a second end portion of the body. In some examples, the second end portion of the body can be located substantially opposite to the first end portion described in block 810. The second weight and the second end portion can be similar in some embodiments to weight 704 and body end portion 744, respectively, as previously described for FIG. 7.

In some examples, one or more of the different parts of method 800 can be combined into a single block. For example, blocks 830 and 840 could be combined in situations where the fastener of block 840 was integrated with the weight of block 830. In the same or a different example, the sequence of one or more of the different steps of method 800 can be changed. As an example, the sequence of steps blocks 810 and 820 could be reversed without affecting the execution of method 800, and similarly, the sequence of blocks 850 and 860 can be reversed. In the same or a different example, method 800 can comprise further or different steps consistent with forming and/or manufacturing a club head.

Although the weighted club heads and methods for forming the same have been described with reference to specific embodiments, various changes may be made without departing from the spirit or scope of the present disclosure. Various examples of such changes have been given in the foregoing description. As another example, the particular shape of boss 106 and cavity 108 as illustrated are not meant to limit the scope of the present disclosure. For example, while boss 106 is shown in the figures as a type of solid-of-revolution based on a square or rectangular cross-section, boss 106 may have any suitable shape and cross-section (e.g., circular, oval, curvilinear, rectilinear, or a combination thereof). Boss 106 may also be tapered or have another suitably varying cross-section. Considering the different examples and embodiments described above, the weighted club heads and methods for forming the same disclosed herein can permit greater adjustment and customization of different design variables used to craft club heads without unduly compromising the manufacturability and the gaming characteristics of the clubs.

Accordingly, the disclosure of embodiments of the weighted club heads and methods for forming the same is intended to be illustrative of the scope of the application and is not intended to be limiting. It is intended that the scope of this application shall be limited only to the extent required by the appended claims. For example, it will be readily apparent that, in some embodiments, boss 106 may terminate within weight 104 (e.g., at approximately half of the thickness of weight 104, as shown in FIG. 4), or may instead extend entirely through weight 104 to form part of sole 162 of club head 100. Additionally, although axis 205 (FIGS. 2-6 and 9) is illustrated to be located at sole 162 of the club head, it can also be located at other portions of the club head. As a further example, in FIG. 4., club head 100 can include convex body surface 202 and concave weight surface 204 without the arcuate surfaces of boss 106 and cavity 108, or vice versa. Therefore, the detailed description of the drawings, and the drawings themselves, disclose at least one preferred embodiment of the weighted club heads and methods for forming the same, and may disclose alternative embodiments thereof.

All elements claimed in any particular claim are essential to the weighted club head and/or method for forming the same claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A method of forming a club head, the method comprising:

providing a body comprising a front surface, a rear surface, an arcuate body surface between the front and rear surfaces, and a first end portion between the front and rear surfaces, wherein the first end portion comprises a lower surface and a boss extending therefrom;

providing a weight extending from the front surface of the body to the rear surface of the body, the weight comprising a top surface, a cavity to receive the boss, and a protrusion comprising an arcuate weight surface; and interlocking the weight with the first end portion of the body;

wherein interlocking the weight with the first end portion of the body comprises:

rotating the weight about an axis normal to the front surface of the body;

interlocking the arcuate weight surface and the arcuate body surface against each other; and interlocking the boss and the cavity against each other.

2. The method of claim 1, wherein:

rotating the weight about the axis comprises:

positioning an extremity of the arcuate weight surface against a first extremity of the arcuate body surface; and moving the weight against the first end portion of the body in an arcuate path;

wherein the arcuate path is defined as the arcuate weight and body surfaces slide past each other when the extremity of the arcuate body surface moves from the first extremity of the arcuate weight surface towards a second extremity of the arcuate weight surface;

interlocking the arcuate weight surface and the arcuate body surface comprises:

pressing the arcuate weight and body surfaces against each other along the arcuate path until the top surface of the weight and the lower surface of the first end portion of the body couple together; and interlocking the boss and the cavity comprises:

pressing the boss against at least one surface of the cavity to couple the top surface of the weight and the lower surface of the first end portion of the body together.

3. The method of claim 1, further comprising:

coupling a fastener through the weight and into the boss;

wherein:

the fastener comprises at least one of a screw, a nail, a rivet, a pin, a soldering material, a brazing material, a magnet, or an adhesive;

when interlocked, one or more of the arcuate body and weight surfaces, the boss, and a surface of the cavity exert shear and tensile stresses against the fastener along at least two substantially perpendicular axes;

when interlocked, one or more interlocking elements of the club head exert shear and tensile stresses against the fastener along at least two substantially perpendicular axes;

at least a portion of the shear and tensile stresses are distributed across an oblique cross-section of the fastener; and the one or more interlocking elements comprise at least one of:

the arcuate body surface;

the arcuate weight surface;

the boss; and a surface of the cavity.

4. The method of claim 3, wherein:

coupling the fastener comprises inserting the fastener along an insertion axis through the weight and into the boss; and the insertion axis is different from the axis normal to the front surface of the body.

5. The method of claim 1, wherein:

interlocking the boss and the cavity against each other comprises:

interlocking a first surface of the boss against a first surface of the cavity to restrict a displacement of the weight along a first axis relative to the body and along a second axis relative to the body; and coupling a third surface of the boss to a third surface of the cavity to restrict a displacement of the weight along a third axis relative to the body; and the first, second, and third axes are substantially perpendicular to each other.

6. The method of claim 1, further comprising:
providing a second weight; and
interlocking the second weight with a second end portion of the body;
wherein the second end portion of the body is located substantially opposite to the first end portion of the body.

7. The method of claim 1, wherein:
rotating the weight about the axis comprises rotating the weight until a bottom surface of the weight is substantially planar with a bottom surface of the body.

8. The method of claim 1, wherein:
interlocking the weight with the first end portion of the body further comprises:
aligning a front surface of the weight to be substantially planar with the front surface of the body; and
forming a strike face of the club head from the front surfaces of the weight and the body.

9. The method of claim 1, further comprising:
removing the weight from the first end portion of the body;
providing a second weight; and
interlocking the second weight with the first end portion of the body.

10. The method of claim 1, wherein:
the axis normal to the front surface of the body is adjacent to a sole of the club head.

11. The method of claim 1, wherein:
providing the body further comprises providing the boss to comprise an arcuate boss surface;
providing the weight further comprises providing the cavity to comprise an arcuate cavity surface complementary to the arcuate boss surface;
interlocking the weight with the first end portion of the body further comprises interlocking the arcuate boss surface with the arcuate cavity surface;
the arcuate boss surface and the arcuate cavity surface form a portion of a first circle;
the arcuate weight surface and the arcuate body surface form a portion a second circle; and
the first and second circles are concentric relative to the axis when the weight and the first end portion of the body are interlocked.

12. The method of claim 11, wherein:
the arcuate boss surface and the arcuate weight surface are concave; and
the arcuate cavity surface and the arcuate body surface are convex.

13. The method of claim 1, wherein:
providing the body further comprises providing the boss to comprise a second arcuate boss surface;
providing the weight further comprises providing the cavity to comprise a second arcuate cavity surface complementary to the second arcuate boss surface;
interlocking the weight with the first end portion of the body further comprises interlocking the second arcuate boss surface with the second arcuate cavity surface;
the second arcuate boss surface and the second arcuate cavity surface form a portion of a third circle;
the third circle is concentric with the first and second circles relative to the axis when the weight and the first end portion of the body are interlocked;
the second arcuate boss surface is convex; and
the second arcuate cavity surface is concave.

14. A club head comprising:
a body comprising a front surface, a rear surface, a convex body surface between the front and rear surfaces, and a first end portion between the front and rear surfaces, wherein the first end portion comprises a first juncture area and a boss extending therefrom; and
a weight configured to extend from the front surface of the body to the rear surface of the body, the weight comprising a second juncture area, a cavity to receive the boss, and a protrusion comprising a concave weight surface;
wherein:
the weight comprises a density greater than a density of the body;
the weight and the first end portion of the body are configured to interlock with each other upon a rotation of the weight about an axis normal to the front surface of the body;
the concave weight surface and the convex body surface are complementary to each other and configured to slide across each other upon the rotation of the weight about the axis;
the concave weight surface is wedged against the convex body surface when the first juncture area of the first end portion is adjacent to the second juncture area of the weight after the rotation of the weight about the axis;
the boss and the cavity comprise arcuate surfaces complementary to each other and are configured to slide across each other upon the rotation of the weight; and
the boss is wedged against at least one surface of the cavity when the first juncture area of the first end portion is adjacent to the second juncture area of the weight after the rotation of the weight about the axis.

15. The club head of claim 14, wherein:
the concave weight surface, the convex body surface, the boss, and the cavity are configured to restrict a vibration of the weight relative to the first end portion of the body when wedged together.

16. The club head of claim 14, further comprising:
a fastener located through the weight and in the boss to secure the weight to the first end portion of the body;
wherein:
the fastener comprises at least one of a screw, a nail, a rivet, a pin, a soldering material, a brazing material, a magnet, or an adhesive; and
when the weight and the first end portion of the body are interlocked, shear and tensile stresses are distributed across an oblique cross-section of the fastener.

17. The club head of claim 14, wherein:
the boss comprises a boss first surface and a boss second surface;
the cavity comprises a cavity first surface and a cavity second surface;
the boss first surface and the cavity first surface are wedged together to restrict a displacement of the weight along a first axis relative to the body and along a second axis relative to the body;
the boss second surface and the cavity second surface are wedged together to restrict a displacement of the weight along a third axis relative to the body; and
the first, second, and third axes are substantially perpendicular to each other.

18. The club head of claim 14, wherein:
the body further comprises a second end portion substantially opposite the first end portion;
the club head further comprises a second weight configured to interlock with the second end portion of the body; and the weight and the second weight are absent from a portion of the body between the first end portion and the second end portion.

19. The club head of claim 14, further comprising at least one of:

a strike face comprising a front surface of the weight substantially planar with the front surface of the body when the boss and the cavity are wedged together; or a sole comprising a bottom surface of the weight substantially planar with a bottom surface of the body when the boss and the cavity are wedged together.

20. The club head of claim 14, further comprising:

a second weight having a mass different than a mass of the first weight;

wherein the second weight is configured to interlock with the first end portion upon a rotation of the second weight about the axis normal to the front surface of the body.

21. The club head of claim 14, wherein the body comprises titanium and the weight comprises tungsten.

22. The club head of claim 14, wherein the club head is a putter head.

23. The club head of claim 14, wherein:

the arcuate surfaces of the boss and the cavity, the concave weight surface, and the convex body surface form portions of concentric circles relative to the axis.

24. A golf club comprising:

a golf club shaft coupled to the body;

a body comprising a front surface, a rear surface, a convex surface between the front and rear surfaces, and a first end portion between the front and rear surfaces, wherein the first end portion comprises a lower surface and a boss extending therefrom;

a weight extending from the front surface of the body to the rear surface of the body, the weight comprising a top surface, a cavity to receive the boss, and a protrusion comprising a concave surface; and a screw inserted through the weight and into the boss;

wherein:

the boss of the body comprises one or more boss arcuate surfaces;

the cavity of the weight comprises one or more cavity arcuate surfaces;

the one or more boss arcuate surfaces and the one or more cavity arcuate surfaces are coupled in a first press-fit against each other after a rotation of the weight about a rotation axis normal to the front surface of the body;

the concave surface of the weight and the convex surface of the body are coupled in a second press-fit against each other after the rotation of the weight;

shear and tensile stresses from the first and second press-fits are obliquely distributed across the screw;

the first press-fit restricts displacement of the weight relative to the body along three restriction axes substantially perpendicular to each other;

the lower surface of the first end portion is located over the top surface of the weight when the boss and the cavity are press-fitted together; and the convex surface of the body is located below the concave surface of the weight when the boss and the cavity are press-fitted together.

25. The golf club of claim 24 wherein:

a first arcuate surface of the one or more boss arcuate surfaces forms an arc of a first circle;

a first cavity arcuate surface of the one or more cavity arcuate surfaces forms the arc of the first circle;

a second arcuate surface of the one or more boss arcuate surfaces forms an arc of a second circle;

a second cavity arcuate surface of the one or more cavity arcuate surfaces forms the arc of the second circle;

the concave surface of the weight forms an arc of a third circle;

the convex surface of the body forms the arc of the third circle;

the first, second, and third circles are concentric about the rotation axis; and the weight comprises a density greater than a density of the body.

* * * * *

UNITED STATES PATENT AND TRADEMARK OFFICE

CERTIFICATE OF CORRECTION

PATENT NO. : 7,604,548 B2
APPLICATION NO. : 12/340269
DATED : October 20, 2009
INVENTOR(S) : Cole It is certified that error appears in the above-identified patent and that said Letters Patent is hereby corrected as shown below:

Column 13, line 48 (Claim 13), delete "claim 1," and insert --claim 11,-- before the text reading "wherein:"

Signed and Sealed this

Twenty-sixth Day of January, 2010

David J. Kappos

David J. Kappos
*Director of the United States Patent and Trademark Office*